US007391985B2

(12) United States Patent
Hosoi

(10) Patent No.: US 7,391,985 B2
(45) Date of Patent: Jun. 24, 2008

(54) IMAGE FORMING APPARATUS WITH POWER SAVING FEATURES

(75) Inventor: Hideaki Hosoi, Fukushima (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/353,610

(22) Filed: Feb. 14, 2006

(65) Prior Publication Data

US 2006/0182457 A1 Aug. 17, 2006

(30) Foreign Application Priority Data

Feb. 17, 2005 (JP) ..... 2005-040699

(51) Int. Cl.
*G03G 15/20* (2006.01)

(52) U.S. Cl. ..... 399/70

(58) Field of Classification Search ..... 399/70
See application file for complete search history.

(56) References Cited

U.S. PATENT DOCUMENTS 5,987,274 A * 11/1999 Satoh ..... 399/69
7,113,719 B2 * 9/2006 Kubota ..... 399/70

FOREIGN PATENT DOCUMENTS

JP 10-161958 A 6/1998

* cited by examiner

*Primary Examiner*—David M Gray
*Assistant Examiner*—Bryan Ready
(74) *Attorney, Agent, or Firm*—Panitch Schwarze Belisario & Nadel LLP

(57) ABSTRACT

The image forming apparatus serves to raise a temperature of fusing section (22) only when an operational item received from operation panel section (3) is determined that an image printing is required. The image forming apparatus includes scanner section (1) for outputting an image data upon reading out an image on a text, image forming section (21) for forming an image on a predetermined print medium based on the image data, fusing section (22) for fusing thus formed image on the predetermined print medium at a prescribed fusing temperature, print requirement determination section (25) for determining as to whether or not an input of a specific operational item received from operation panel section (3) requires an image printing thereof, in which fusing temperature controlling section (23) serves to control a temperature rise of fusing section (22) on the basis of the determination by print requirement determination section (25) that the image printing is required.

23 Claims, 15 Drawing Sheets

IMAGE FORMING APPARATUS WITH POWER SAVING FEATURES

BACKGROUND OF THE INVENTION

1. Field of the Invention

The present invention relates to an image forming apparatus, more specifically to an energy saving function of the image forming apparatus.

2. Description of Related Art

Conventionally, an image forming apparatus including a scanner section and a printer section has been proposed. Such an image forming apparatus includes a scanner function for reading a text and transferring an image data thereof to an external apparatus and a copying function for printing the image data of the text read by the scanner section by the printer section (see Japanese Patent Laying-Open No. 10-161958). Such kind of apparatus is required to have an energy saving function for reducing power consumption. To achieve this function, such an apparatus is configured such that a temperature of a fusing section of the printer section is lowered than a fusing temperature when the image forming apparatus is in a standby state, while the temperature of the fusing section is raised up to the fusing temperature when an operator sets the text on the scanner section.

The above described apparatus is used by the operator for two kinds of purposes such as a case where the scanner section reads out the text to copy the image data thereof and a case where the scanner section reads out the text to transfer the image data of the text to the exterior apparatus without copying the text. Therefore, as stated above, such a configuration that the temperature of the fusing section is always raised up to the fusing temperature when the operator sets the text on the scanner section will involve an excessive electric power consumption in the case where the scanner section reads out the text and transfers the image data of the text to the exterior apparatus without copying the text.

The present invention is directed to resolve a problem that the excessive electric power consumption is necessitated for the reason that the temperature of the fusing section is always raised up to the fusing temperature regardless of the cases where the scanner section reads out the text to copy the image data thereof and where the scanner section reads out the text to transfer the image data of the text to the exterior apparatus without copying the text, when the operator sets the text on the scanner section.

The present invention is mainly featured in that an input of a specific operational item received from an operation panel section includes a print requirement determination section for determining as to whether or not an image printing by an image printing means is needed and a fusing temperature controlling section for starting a control of raising a temperature of a fusing section on the basis of a determination by the print requirement determination section indicating that an image printing is required.

Since the control of raising the temperature of the fusing section is started when the operational item received from the operation panel section is determined as requiring the image printing, the temperature of the fusing section can be raised while the operator is setting a copying condition or the like, resulting in being capable of facilitating a copying timing and avoiding unnecessary electric power consumption since the temperature of the fusing section is not raised when the image printing is not required.

DETAILED DESCRIPTION

This invention may take physical form in certain parts and arrangements of parts, a preferred embodiment and method of which will be described in detail in this specification and illustrated in the accompanying drawings which form a part hereof, and wherein.

With the input of the specified operational item received from the operation panel section, a control means of CPU (microprocessor) built in the apparatus realizes, without increasing the number of parts for the apparatus, the print requirement determination section for determining as to whether or not an image printing by an image printing means is required and the fusing temperature controlling section for starting the control of raising a temperature of the fusing section on the basis of the determination by the print requirement determination section indicating that an image printing is required.

According to the present embodiment, the image forming apparatus is provided with a copy mode selecting recognition section for recognizing if the operator depressed a copy mode button of the operation panel section, and the temperature of the fusing section is started to be raised when the copy mode recognition section recognizes that the copy mode button was depressed by the operator.

Figure 1:
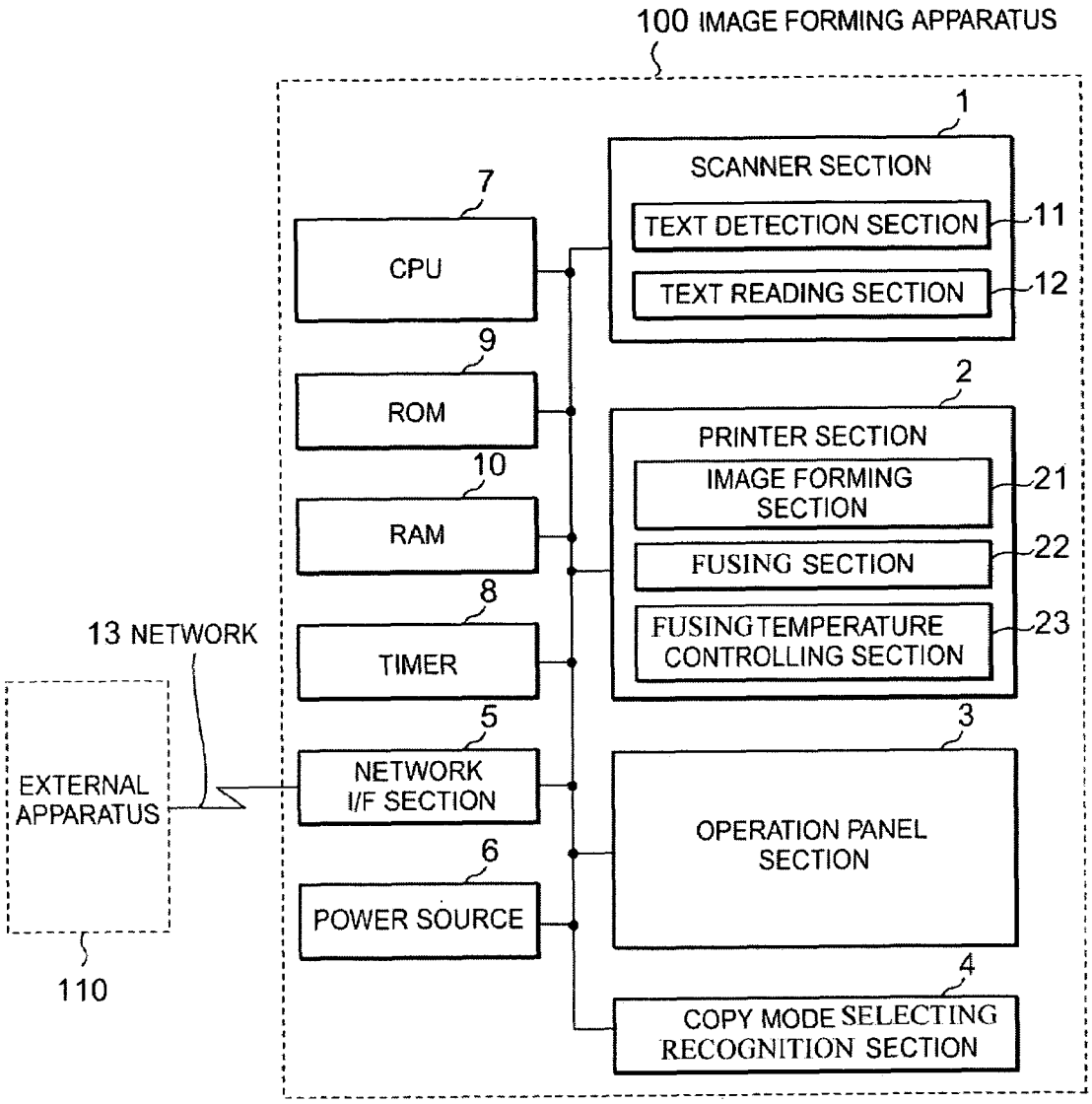
FIG. 1 is a block diagram illustrating a configuration of the image forming apparatus according to the first embodiment.

FIG. 1 is a block diagram illustrating a configuration of the image forming apparatus according to a first embodiment.

As shown in FIG. 1, image forming apparatus 100 includes scanner section 1, printer section 2, operation panel section 3, copy mode selecting recognition section 4, network I/F section 5, power source 6, CPU 7, timer 8, ROM 9 and RAM 10.

Scanner section 1 having text detecting section 11 and text reading section 12 reads out an image on the text to output an image data thereof. The schematic configuration of this section is explained.

Figure 2:
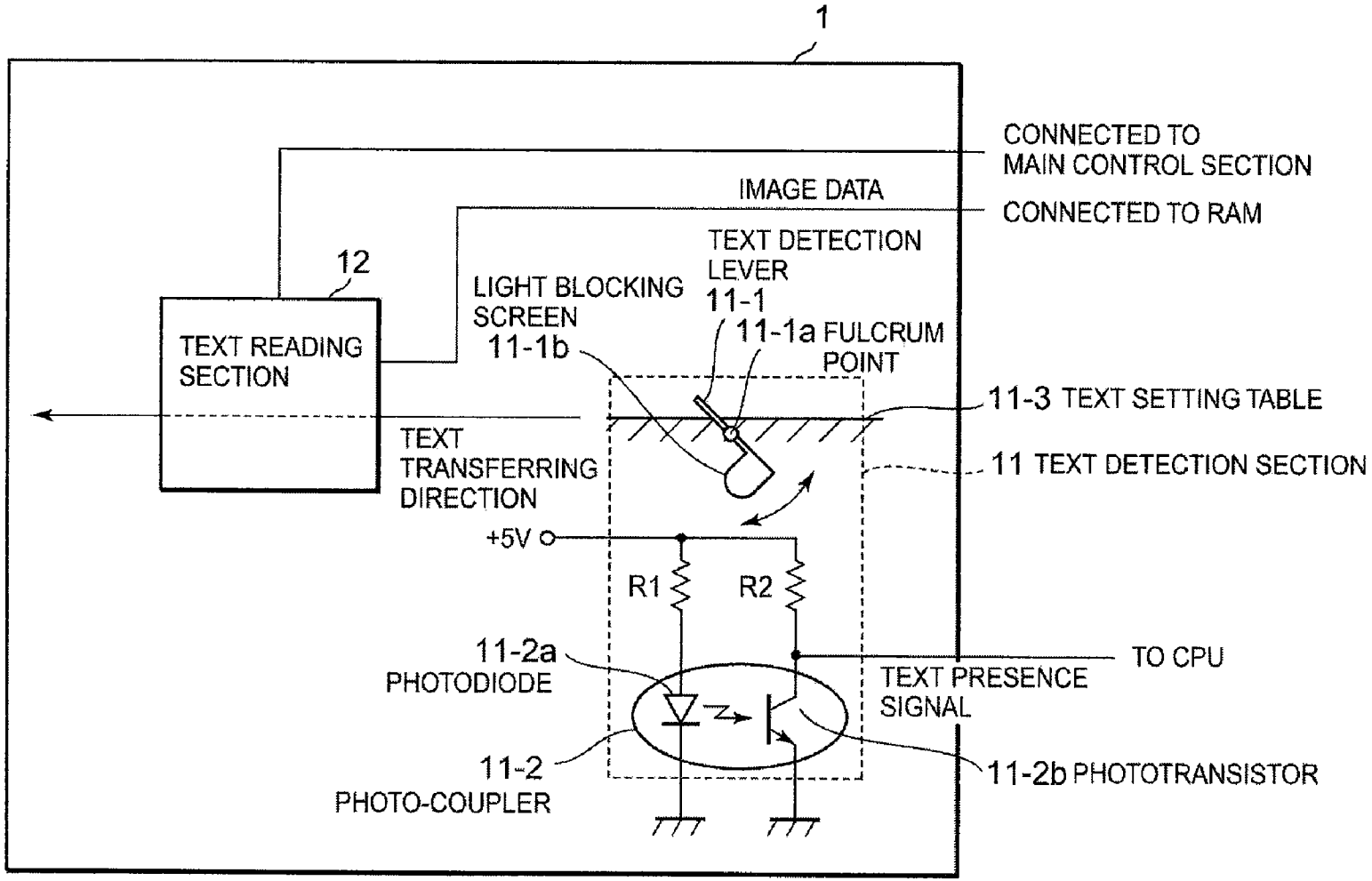
FIG. 2 is a schematic view illustrating a configuration of the scanner section.

FIG. 2 is a schematic view illustrating a configuration of the scanner section.

In FIG. 2, text detection section 11 is composed of text detection lever 11-1, photo-coupler 11-2, resistor R1 and resistor R2.

Text detection lever 11-1 is attached to text setting table 11-3 such that the lever is pivotable around fulcrum point 11-1*a* in a direction as shown by an arrow in FIG. 2. If the text is not set on text setting table 11-3, light blocking screen 11-1*b* pivots by its dead-load around fulcrum point 11-1*a* in the arrow direction (clockwise direction) to block a light path crossing from photodiode 11-2*a* to phototransistor 11-2*b*. At this moment, phototransistor 11-2*b* becomes off to output a text presence signal, indicative of absence of text, of about 5V (volts) is output trough resistor R2 to CPU 7.

When the text is set on text setting table 11-3, light blocking screen 11-1*b* pivots in an arrow direction (namely, counter-clockwise direction) around fulcrum point 11-1*a* against its dead-load to form a light path crossing from photodiode 11-2*a* to phototransistor 11-2*b*. At this moment, phototransistor. 11-2*b* becomes on, resistor R2 is grounded, and the text presence signal indicative of the presence of the text, of about 0V (volt) is output to CPU 7.

Text reading section 12 reads out an image on the text from text setting table 11-3 conveyed by a text conveying means which is not shown. The image data read out here is stored in RAM 10 (FIG. 1).

Turning back to FIG. 1, printer section 2 having image forming section 21, fusing section 22 and fusing temperature controlling section 23 reproduces the image onto a predetermined print medium based on the image data upon reception of the image data from the above stated text reading section 12 to have the reproduced image e fused on the medium at a prescribed fusing temperature. A general configuration of this section is illustrated in FIG. 1.

Figure 3:
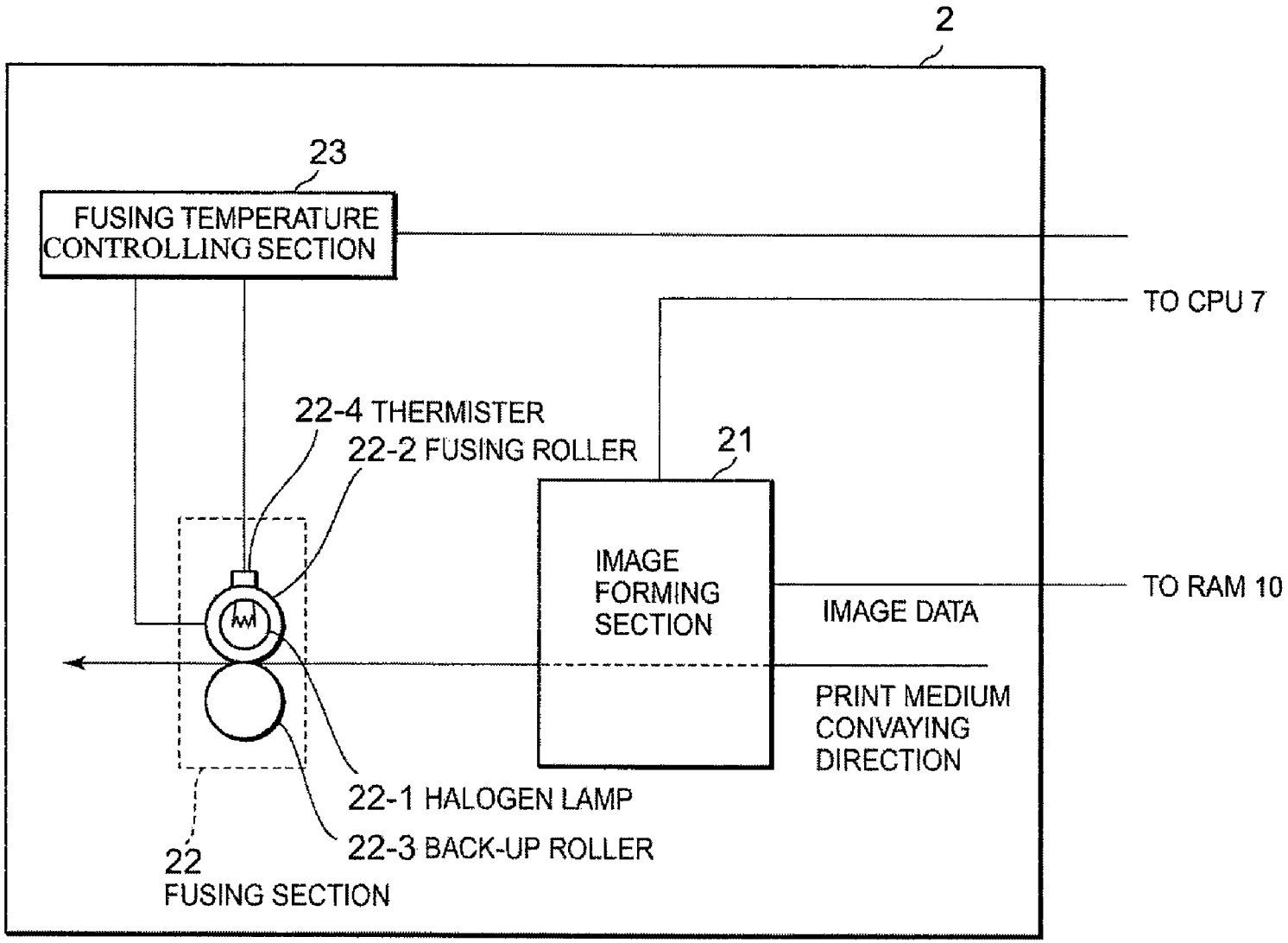
FIG. 3 is a schematic view illustrating a configuration of the printer section.

FIG. 3 is a schematic view illustrating a configuration of the printer section.

In FIG. 3, image forming section 21 forms an image with developer on the basis of the image data received from RAM 10 (FIG. 1) onto the print medium conveyed by the print medium conveying means which is not shown.

Fusing section 22 is composed of fusing roller 22-2 with built-in halogen lamp 22-1, back-up roller 22-3 to be disposed such that the roller press-fits fusing roller 22-2, and thermister 22-4 disposed in the vicinity of fusing roller 22-2.

Fusing temperature controlling section 23 has a function that an electric power supplied from power source 6 (FIG. 1) is energized to or interrupted from halogen lamp 22-1, a function that a resistant value of thermister 22-4 which varies according to the temperature is read out to convert it to a temperature in order to detect a temperature of fusing section 22, and a function of maintaining a constant temperature in which the energization and interruption of the electric power to halogen lamp 22-1 is performed automatically in order to keep fusing section 22 at the prescribed temperature on the basis of thus detected temperature.

Fusing temperature controlling section 23 is activated such that CPU 7 (FIG. 1), executes a preset controlling program preliminary stored in ROM 9 (FIG. 1). The image on the print medium that has been formed by image forming section 21 is fused onto the print medium upon passing through between fusing roller 22-2 kept at the prescribed fusing temperature and back-up roller 22-3.

Now turning back to FIG. 1, operation panel section 3 enables an input of a plural operational items (including modes) by the operator in connection with an image data treatment. Explained are various operation input (selection) keys that are arranged on this section.

Figure 4:
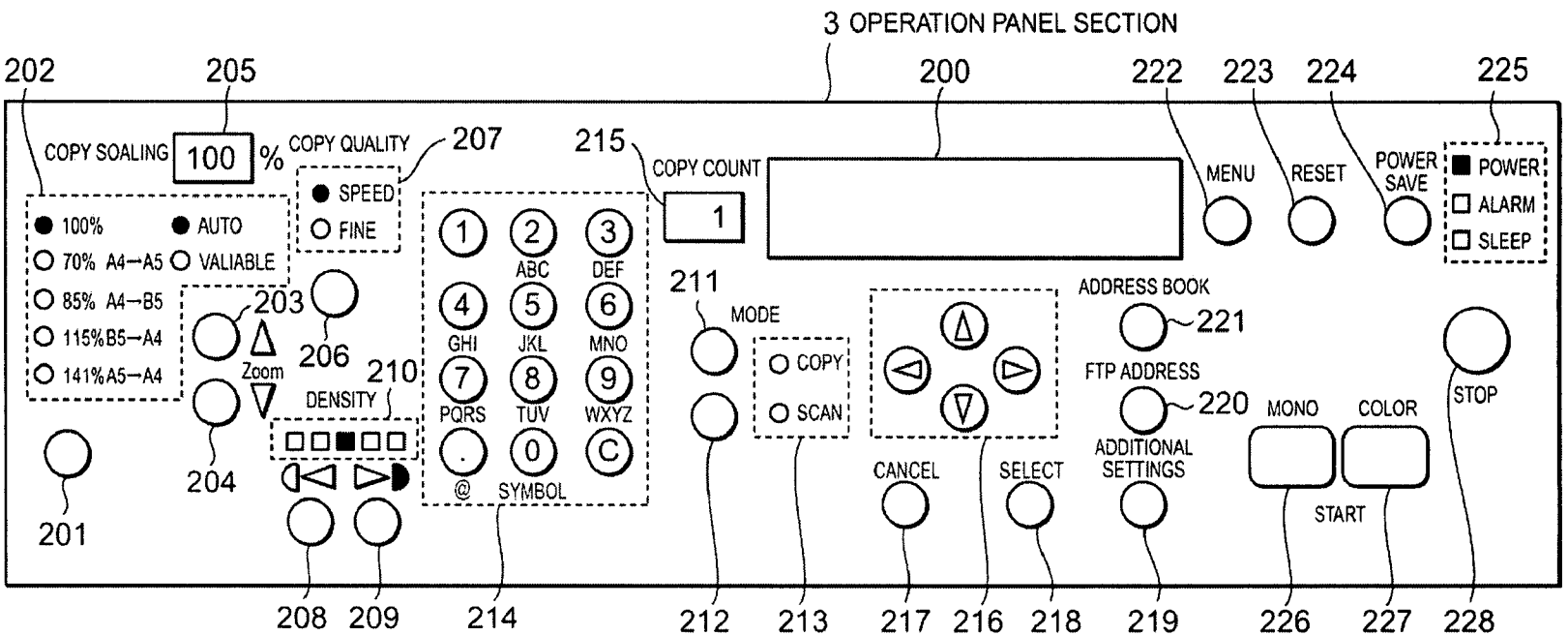
FIG. 4 is a layout of the operation panel section.

FIG. 4 is a schematic view illustrating the operation panel section.

In FIG. 4, 200 denotes a LCD (liquid crystal display) for indicating conditions or various setting screens of the apparatus. 201 denotes a copying magnification setting key in which copying magnification is represented by % when lighting of LED 202 for the use of copying magnification indication is switched every time the operator depresses the copying magnification setting key. 203 and 204 denote zoom-up keys for the use of copying in which the copying magnification setting can be increased/decreased in unit of a predetermined percentage. 206 denotes a copying resolution setting key in which lighting of LED 207 for the use of copying resolution indication is switched every time the operator depresses the copying resolution setting key. 208 and 209 denote reading density setting keys for setting whether or not a text image is to be read out rather in light or in dark in which LED 210 for indicating reading dense is switched level by level every time the operator depresses the reading dense setting key.

211 and 212 denote mode selecting keys in which a copying mode is selected when the operator depresses copying mode selecting key 211, while a scanning mode is selected when the operator depresses scanning mode selecting key 212. 213 denotes LED for indicating mode in which LED corresponding to a mode selected by either one of mode selecting keys 211 and 212 lights up. 214 denotes a numerical keypad for inputting the number of copies in a copying mode, and for inputing a mail address and the like in a scanning mode, respectively. 215 denotes a copying-number indicating device for indicating the number of copies to be set and input.

219 denotes an additional setting key for having LCD 200 display a copy relating additional setting screen other than the screens described above in a copying mode and a scan relating additional setting screen in a scanning mode, respectively. 222 denotes a menu key having LCD 200 display various apparatus setting screens. 216 denotes a cursor move key for selecting one of a plurality of options displayed on LCD 200 upon depression of additional setting key 219 or menu key 222, in which a cursor is movable from right to left and up and down. 218 denotes a setting key for defining a setting selected by cursor move key 216, and 217 denotes a cancel key for canceling the setting once defined.

220 denotes a FTP address call key for having LCD 200 display an address of FTP server, 221 denotes a mail address call key for having LCD 200 display a mail address, 223 denotes a reset key for resetting the setting input, and 224 denotes a power save key for placing an apparatus in a standby state to a power save mode or for recovering the apparatus in power save mode to a standby state.

The power save mode is a mode for establishing a better reduction mode of the power consumption than the apparatus in the standby mode by interrupting a supply of electric power to fusing section 22 (FIG. 1) or a driving section other than the one shown here. Hereinafter, both of the standby state and the power save mode or either one of the standby state or the power save mode are referred to as an energy saving mode. 225 denotes a LED group for displaying a power source on/off state, an alarm raising condition and a power save mode on/off state, respectively. 226 and 227 denote start keys for providing an instruction to start the text reading in monochrome mode and in color mode, respectively. 228 denotes a stop key for stopping an operation of the apparatus.

Turning back to FIG. 1, copying mode selecting recognition section 4 serves to recognize that the operator depressed copying mode selecting keys 211, 212 (FIG. 4). The copying mode selecting recognition section has fusing temperature controlling section 23 start to raise the temperature of fusing section 22 upon recognizing that the operator depresses copying mode selecting key 211 (FIG. 4). The copying mode selecting recognition section further serves to start a processing of scanning mode upon recognizing a depression of scanning mode selecting key 212 (FIG. 4) by the operator. The copying mode selecting recognition section is activated when CPU 7 executes the preset controlling program preliminary stored in ROM 9.

Network I/F section 5 is an interface circuit for establishing a communication connection between external apparatus 110 and image forming apparatus 100 through network 13 on the basis of the control by CPU 7.

Power source 6 serves to supply a desired power to each section of the apparatus.

CPU 7 is a microprocessor for controlling the apparatus in its entirety by executing the preset controlling program preliminary stored in ROM 9. In addition to an ordinary control (the explanation thereof is omitted here), the CPU according to the present embodiment serves to activate fusing temperature controlling section 23 and copying mode selecting recognition section 4 by executing the preset controlling program preliminary stored in ROM 9.

Timer 8 is a clock means for measuring a time lapse required in the process where CPU 7 executes various controls. Generally, a timer provided in CPU 7 takes a roll of this clock means.

ROM 9 is a read only memory in which a controlling program to be executed by CPU 7 for controlling the entire apparatus is preliminary stored. Besides the ordinary controlling program (the explanation thereof is omitted here), the read only memory according to the present embodiment preliminary stores the controlling grogram to be executed by CPU 7 for activating fusing temperature controlling section 23 and copying mode selecting recognition section 4.

RAM 10 is a random access memory to be used temporarily as a working area when CPU 7 executes the preset program.

Figure 5:
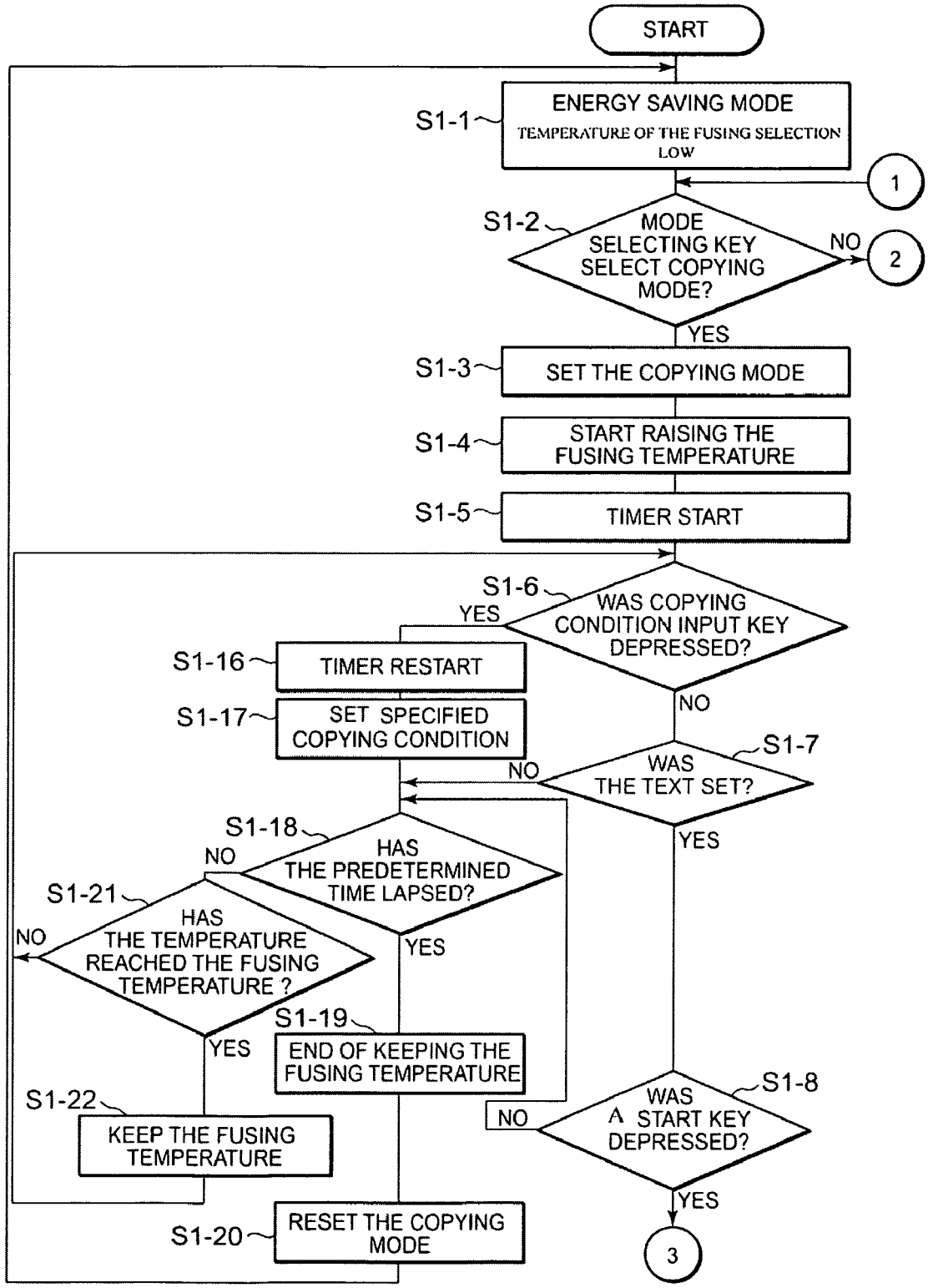
FIG. 5 is a flow chart I illustrating the operations of the image forming apparatus according to the first embodiment.

FIG. 5 is a flow chart I illustrating operations of the image forming apparatus according to the first embodiment.

Figure 6:
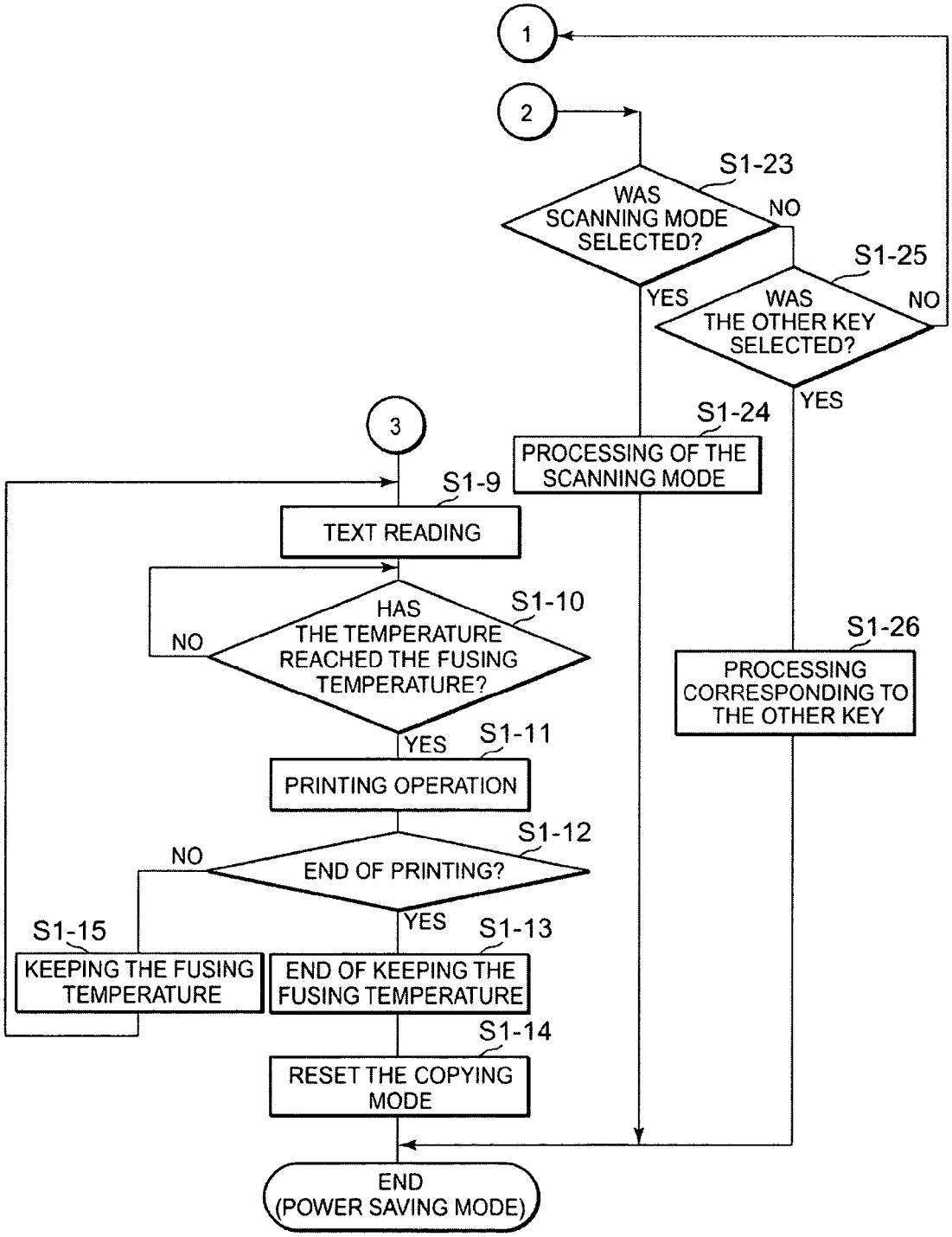
FIG. 6 is a flow chart II illustrating the operations of the image forming apparatus according to the first embodiment.

FIG. 6 is a flow chart II illustrating operations of the image forming apparatus according to the first embodiment.

The flows illustrated in FIGS. 5 and 6 are achieved such that CPU 7 (FIG. 1) reads out and executes the controlling program stored in ROM 9 (FIG. 1). The operations of the image forming apparatus is explained step by step from step S1-1 to step S1-26 referring to the drawings.

Step S1-1 (FIG. 5)

Image forming apparatus 100 (FIG. 1) is on standby in energy saving mode (namely, the temperature of the fusing section is low).

The operator operates operation pane section 3 (FIG. 4) to input desirable mode. In the case where the operator depresses one of selecting keys 211, 212 (FIG. 4) to select a copying mode, the step goes to step S1-3, whereas in the case where the copying mode is not selected here, the step goes to step S1-23.

Step S1-3

Copying mode selecting recognition section 4 (FIG. 1) recognizes that the copying mode was selected.

Step S1-4

Copying mode selecting recognition section 4 (FIG. 1) has fusing temperature controlling section 23 (FIG. 1) start to control the fusing temperature. Fusing temperature controlling section 23 (FIG. 1) energizes halogen lamp 22-1 (FIG. 3) to raise the temperature of fusing roller 22-2 (FIG. 3).

Step S1-5

Fusing temperature controlling section 23 (FIG. 1) has timer 8 (FIG. 1) start.

Step S1-6

In the case where the operator depressed any one of so-called copying condition input keys such as copying magnification setting key 201 (FIG. 4), zoom-up keys for copying 203, 204 (FIG. 4), copying resolution setting key 206 (FIG. 4), key pad 214 as a copying-number input key or additional setting key 219 (FIG. 4), the step goes to step S1-16, whereas in the case where the operator depressed none of them, the step goes to step S1-7.

Step S1-7

Text detecting section 11 (FIG. 2) upon detecting the text, outputs the text presence signal of about 0V (volt) to CPU 7 (FIG. 1) and the step goes to step S1-8, whereas if the text detecting section detects no text, the step goes to step S1-18.

Step S1-8

In the case where CPU 7 (FIG. 1) recognizes that the operator depressed start key 226 or 227 (FIG. 4), the step goes to step S1-9, whereas in the case where the CPU recognizes that the operator depressed no start key, the step goes to step S1-18.

Step S1-9 (FIG. 6)

Text reading section 12 (FIG. 2) starts to read out the text.

Step S1-10

Fusing temperature controlling section 23. (FIG. 3) monitors thermister 22-4 (FIG. 3) and when the temperature of fusing roller 22-2 (FIG. 3) reaches the prescribed fusing temperature, the step then goes to step S1-11.

Step S1-11

Image forming section 21 (FIG. 3) starts a printing operation.

Step S1-12

When image forming section 21 (FIG. 3) terminates the printing operation, the step goes to step S1-13, while if the printing operation is continuing, the step goes to step S1-15.

Step S1-13

Fusing temperature controlling section 23 (FIG. 3) terminates to keep the fusing temperature.

Step S1-14

CPU 7 (FIG. 1) resets the copying mode to terminate the flow of the printing operation, and then returns to the energy saving mode.

Step S1-15

Fusing temperature controlling section 23 (FIG. 3) keeps the fusing temperature since the printing operation has not been terminated and, as a result, the step goes back to S1-9. Then, a sequential loop composed of the steps S-9, S-10, S1-11, S1-12, S1-15, S1-9 is repeated in this order, and upon termination of the printing operation, the step goes out from the loop at step S1-12 to step S1-13 to terminate the flow of the printing operation.

Step S1-16 (FIG. 5)

Upon setting of the copying conditions, fusing temperature controlling section 23 (FIG. 1) resets and restarts timer 8 (FIG. 1). This is because, even if the operator depresses any one of so called copying condition setting keys such as copying magnitude setting key 201 (FIG. 4), zoom-up keys for copying 203, 204 (FIG. 4), copying resolution setting key 206 (FIG. 4), key pad 214 (FIG. 4) as the copying-number input key and additional setting key 219 (FIG. 4), and even subsequent thereto if the operator does not input an activation of the copying operation within a predetermined time period, such situation has to be considered that the copying mode is abandoned.

Step S1-17

When the operator inputs a value for setting the copying condition on item, the step goes to step S1-18.

Step S1-18

Fusing temperature controlling section 23 (FIG. 1) monitors timer 8 (FIG. 1) and, if it's time out, the step goes to step S1-19, whereas if it is not time out, the step goes to step S1-21.

Step S1-19

Fusing temperature controlling section 23 (FIG. 1) terminates to keep the fusing temperature. Here, there is a high possibility that the operator halted the operation or went away from the apparatus for some reasons after he selected the copying mode, and therefore keeping the fusing temperature is not required any more.

Step S1-20

CPU 7 (FIG. 1) resets the copying mode and then the step goes back to step S1-1.

Step S1-21

Fusing temperature controlling section 23 (FIG. 3) monitors thermister 22-4 (FIG. 3) and, if the temperature has reached the fusing temperature, the step goes to step S1-22, whereas if the temperature has not reached the fusing temperature, the step goes back to step S1-6.

Step S1-22

Fusing temperature controlling section 23 (FIG. 3) goes back to step S1-6 with the fusing temperature kept as it is.

Step S1-23 (FIG. 6)

If the operator operated operation panel section 3 (FIG. 4) to have mode selecting keys 211, 212 (FIG. 4) select the scanning mode, the step goes to step S1-24, and in any other situation than the foregoing, the step goes to step S1-25.

Step S1-24

CPU 7 (FIG. 1) executes a processing of the scanning mode to terminate the flow of the operation.

Step 51-25

If there is an input by other key, the step goes to step S1-26, whereas if there is no input by other key, the step goes back to step S1-2.

Step S1-26

CPU 7 (FIG. 1) executes a processing corresponding to the input by the other key to terminate a flow of the operation.

As all of the steps in the flow of the operation has been finished, supplemental explanations are given to the steps S1-7 and S1-8. In step S1-7, if it takes time to set the text due to an inexperience or the like by the operator, such a loop is repeated that steps goes through S1-18, S1-21 or S1-22, S1-6, S1-7, S1-18 in this order as far as within a time period set in step S1-5, and if the text is set during which loop, the step goes forward from step S1-7 to step S1-8. However, if the text is not set during which period, it becomes time over, and therefore the step goes back from step S1-18 to the step S1-1 through step S1-19 in order to-repeat the steps again from top. Step S-18 follows the same loop.

As explained above, image forming apparatus 100 according to the present embodiment includes copying mode selecting recognition section 4 for recognizing that the operator depressed the copying mode button of the operation panel section, in which a control to raise the temperature of the fusing section is started when copying mode selecting recognition section 4 recognizes that the operator depressed the copying mode button. As such, while the operator is setting the copying conditions, the temperature of the fusing section can be raised. Therefore, advantageous effect can be produced that the copying timing can be facilitated, and besides, unnecessary electric consumption is avoidable since the temperature of the fusing section is prevented from being raised when image printing is not required.

In the above stated first embodiment, a rise of the temperature of the fusing section can be started only by a depression of the copying mode selecting key 211 by the operator (FIG. 4). However, according to the present embodiment, even before depressing copying mode selecting key 211 (FIG. 4), if operator depressed the copying condition setting key such as copying magnitude setting key 201 (FIG. 4) or copying resolution setting key 206 (FIG. 4) or the like, the temperature of the fusing section is started to be raised since it is obvious the operator is desiring the image printing.

Figure 7:
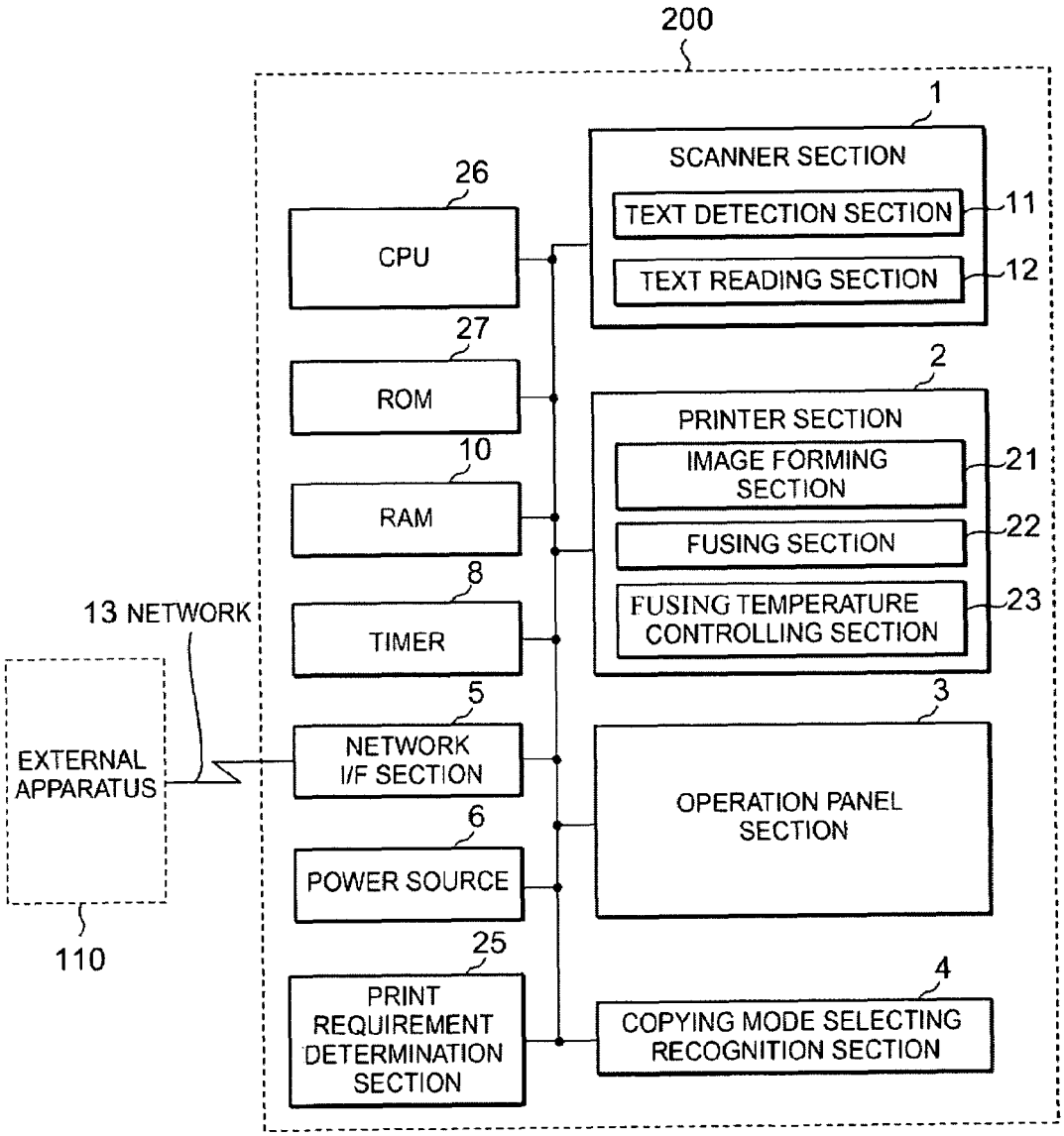
FIG. 7 is a block diagram illustrating a configuration of the image forming apparatus according to the second embodiment.

FIG. 7 is a block diagram illustrating a configuration of the image forming apparatus according to the second embodiment.

Image forming apparatus 200 as shown in FIG. 7 includes scanner section 1, printer section 2, operation panel section 3, copying mode selecting recognition section 4, network I/F section 5, power source 6, timer 8, RAM 10, print requirement determination section 25, CPU 26 and ROM 27. Only the components which are not described in the first embodiment are explained hereinafter. The similar components as those in the first embodiment are assigned with the identical numerals and/or symbols, thereby allowing the omission of explanation thereof.

Print requirement determination section 25 determines whether or not an input of the specific operational item received from operation panel section 3 requires an image printing by printer section 2, and allows fusing temperature control section 23 to start to raise the temperature of fusing section 22 upon determination that the image printing is required. In other words, when the operator depresses copying magnitude setting key 201 (FIG. 4), copying resolution setting key 206 (FIG. 4) or the like, the print requirement determination section determines that the image printing is required, thereby causing fusing temperature control section 23 to start to raise the temperature of fusing section 22. The print requirement determination section is activated by CPU 7 at a time which executes a preset controlling program preliminary stored in ROM 9.

CPU 26 is a micro processor for controlling the entire apparatus upon execution of the preset controlling program preliminary stored in ROM 27. In addition to the ordinary control (explanation thereof is omitted here), the CPU activates fusing temperature control section 23 and copying mode selecting recognition section 4 by executing the preset controlling program preliminary stored in ROM 27. Further, in the present embodiment, the CPU activates print requirement determination section 25 upon execution of the preset controlling program preliminary stored in ROM 27.

ROM 27 is a read-only-memory in which a controlling program to be executed by CPU 26 for controlling the entire apparatus is preliminary stored. The ROM is the read-only-memory in which the controlling program to be executed by CPU 26 for activating fusing temperature control section 23 and copying mode selecting recognition section 4 is preliminary stored besides the ordinary controlling program (the explanation there is omitted here). Further, in the present embodiment, the ROM is the read-only-memory in which the controlling program to be executed by CPU 26 for activating print requirement determination section 25 is preliminary stored.

Figure 8:
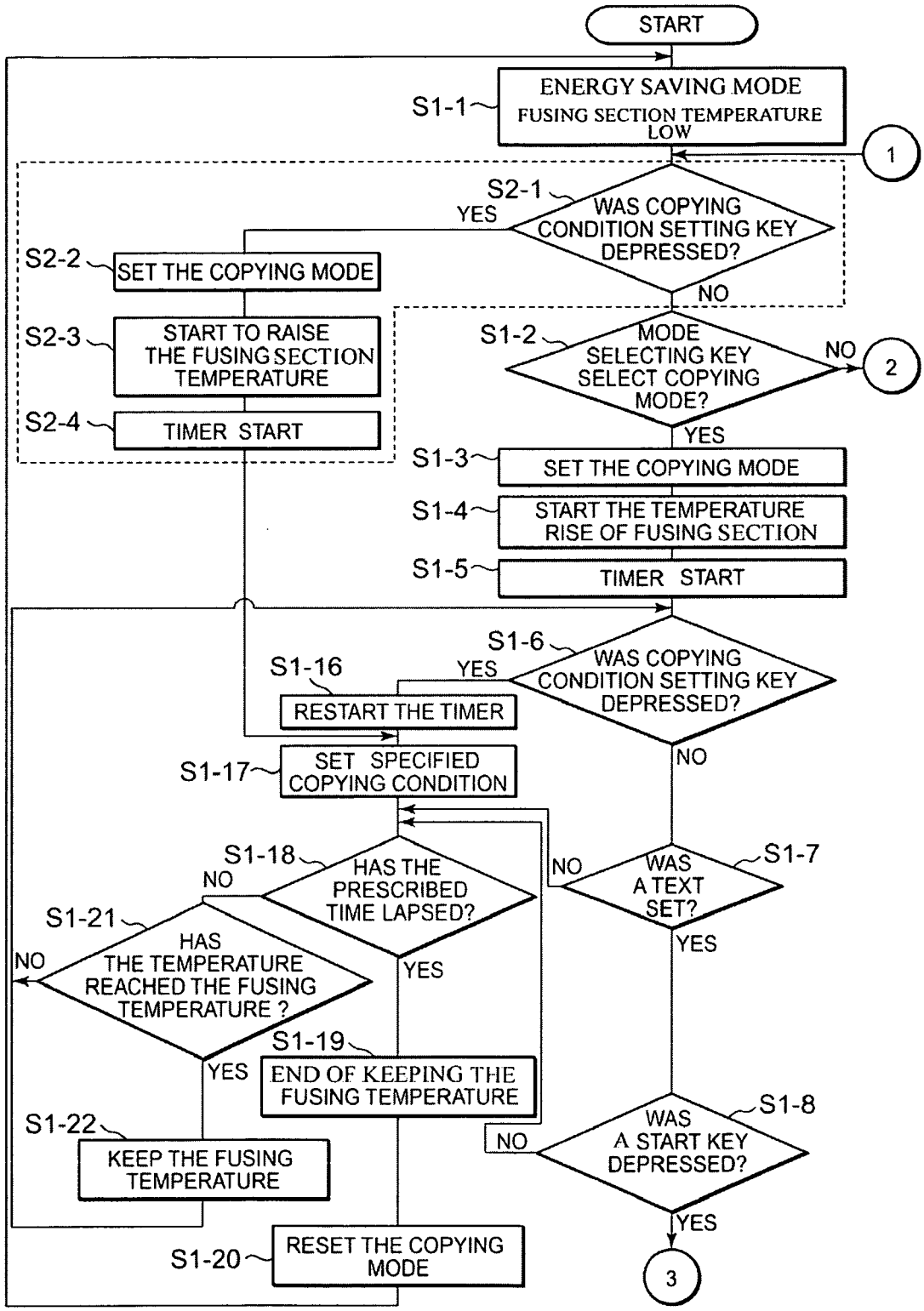
FIG. 8 is a flow chart I illustrating the operations of the image forming apparatus according to the second embodiment.

FIG. 8 is a flow chart I illustrating operations of the image forming apparatus according to the second embodiment.

Figure 9:
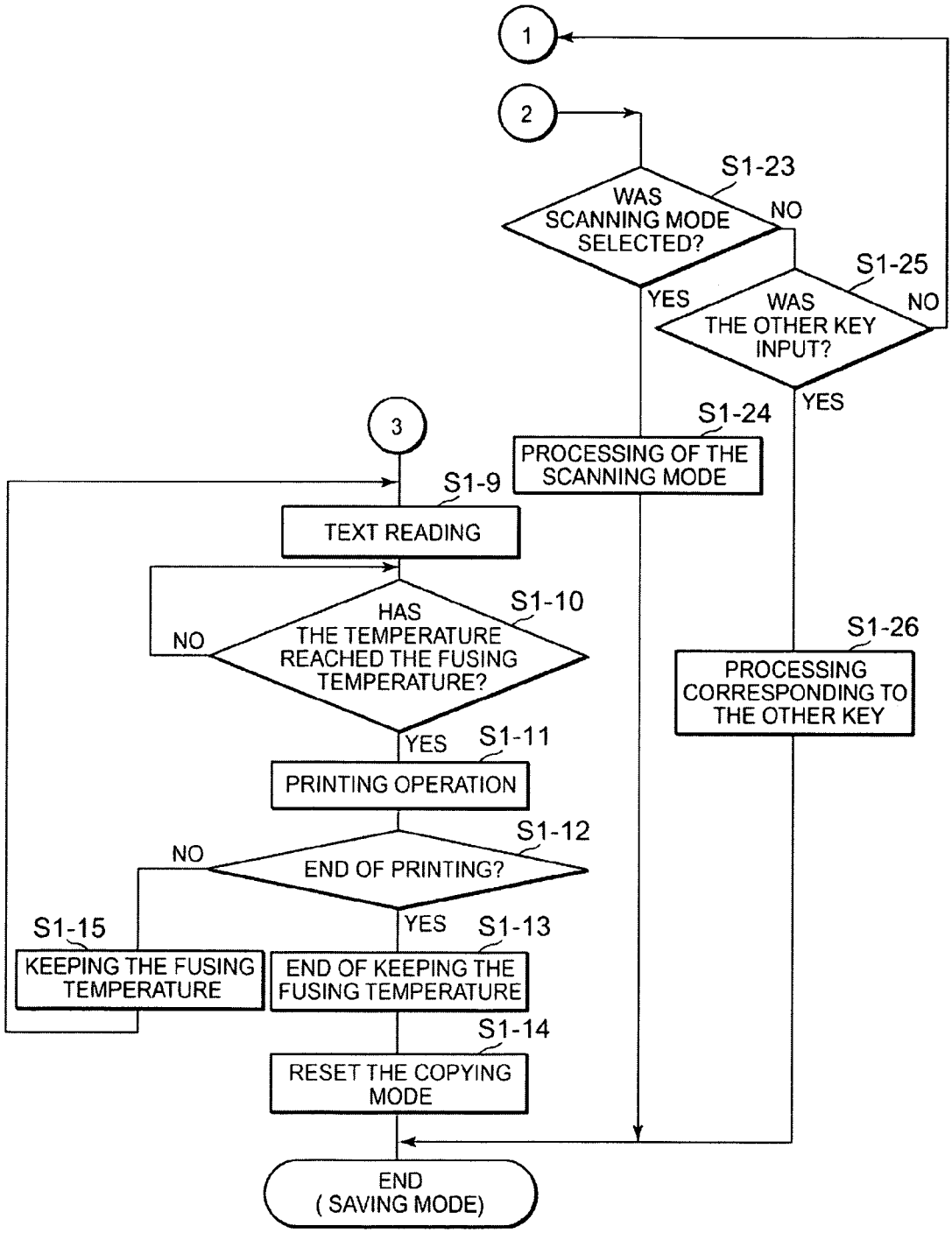
FIG. 9 is a flow chart II illustrating the operations of the image forming apparatus according to the second embodiment.

FIG. 9 is a flow chart II illustrating operations of the image forming apparatus according to the second embodiment.

These flows of the operations in FIGS. 8 and 9 are achieved such that CPU 26 (FIG. 7) reads out and executes the controlling program stored in ROM 27 (FIG. 7). The operations of the image forming apparatus of the present embodiment differs from those of the first embodiment only in that additional operations encircled by dotted-line, i.e., steps S2-1 to S2-4, are additionally inserted between the steps S1-1 and S1-2 according to the first embodiment. The other operations are identical to the operations of the image forming apparatus in the first embodiment, and therefore, the steps S2-1, S2-2, S2-3 and S2-4 are explained here and the other steps are omitted for their explanations but are assigned with the same step numbers as those in the first embodiment.

Step S2-1 (FIG. 8)

Print requirement determination section 25 (FIG. 7) determines whether or not the key depressed by the operator is one of copying condition setting keys requiring printing, such as copying magnitude setting key 201 (FIG. 4), copying resolution setting key 206 (FIG. 4) or the like. If the key depressed by the operator is the copying condition setting key, the step goes to step S2-2. If the key depressed by the operator is not the copying condition setting key, the step goes to step S1-2 to follow the flow of the operations similar to that of the first embodiment.

Step S2-2

Print requirement determination section 25 (FIG. 7) recognizes that the copying mode is selected.

Step S2-3

Print requirement determination section 25 (FIG. 7) has fusing temperature controlling section 23 (FIG. 7) start to control the fusing temperature. Fusing temperature controlling section 23 (FIG. 7) energizes halogen lamp 22-1 (FIG. 3) to raise the temperature of fusing roller 22-2 (FIG. 3).

Step S2-4

Fusing temperature-controlling-section 23 (FIG. 7) has timer 8 (FIG. 7) start. Then, the step goes to step S1-17 to follow the flow of operaions similar to that of the first embodiment.

As stated above, if the copying condition setting key is depressed even before copying mode selecting key 211 (FIG. 4) is depressed, print requirement determination section 25 (FIG. 7) determines that the image printing is required to have fusing section 22 (FIG. 7) start to raise the temperature, resulting in a temperature rise of fusing section 22 (FIG. 7) while the operator is setting the copying condition. Therefore, such advantageous results can be produced that a copying timing can be accelerated and unnecessary electric consumption is avoidable since the temperature rise of fusing section 22 (FIG. 7) can be prevented when the image printing is not required.

The present embodiment has a text removal determination section to halt the fusing temperature keeping operation immediately upon detection of a text removal because the printing operation becomes unnecessary if once the text was set but is removed thereafter.

Figure 10:
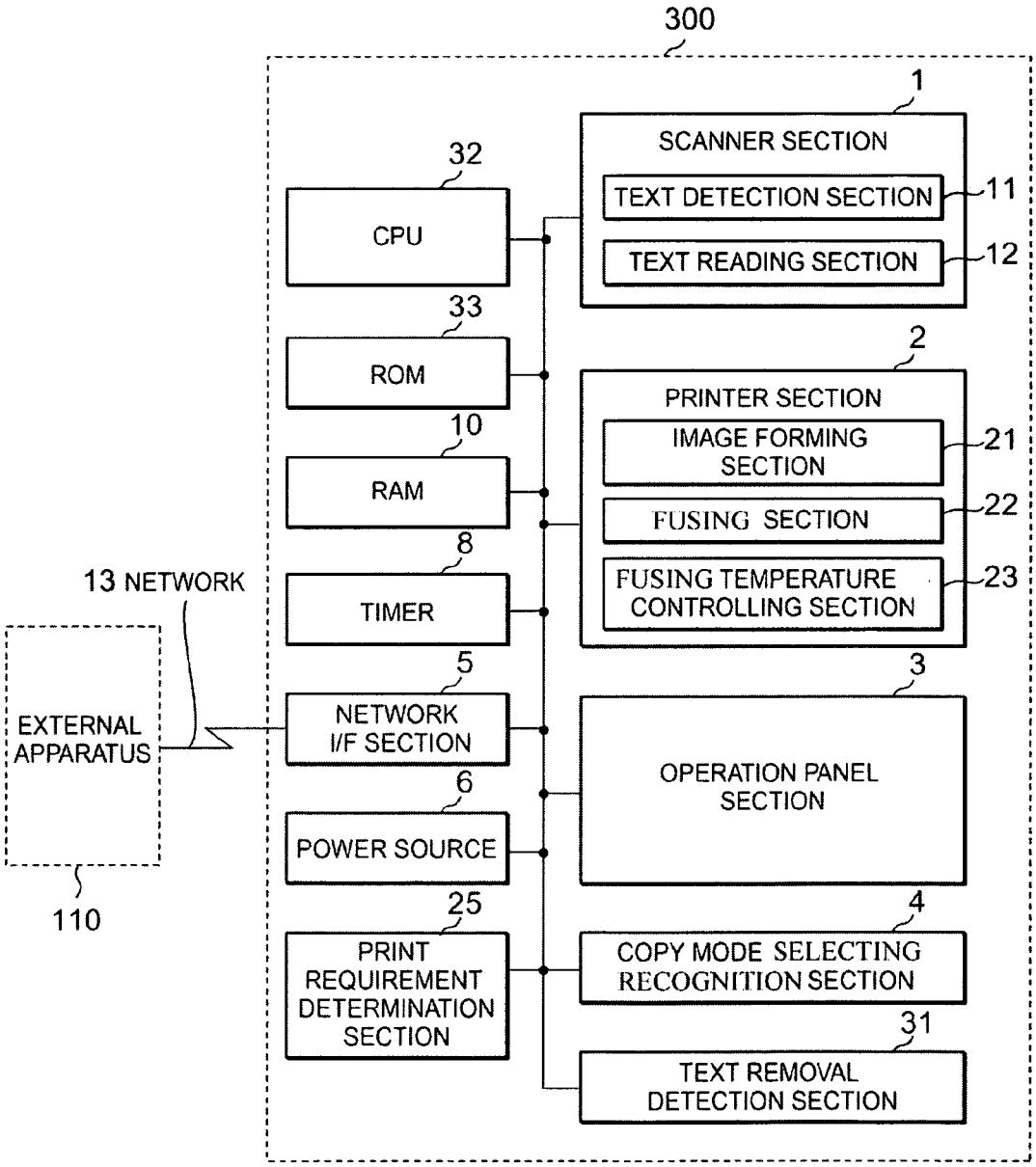
FIG. 10 is a block diagram illustrating a configuration of the image forming apparatus according to the third embodiment.

FIG. 10 is a block diagram illustrating a configuration of the image forming apparatus according to the third embodiment.

As shown in FIG. 10, image forming apparatus 300 has scanner section 1, printer section 2, operating panel section 3, copying mode selecting recognition section 4, network I/F section 5, power source 6, timer 8, RAM 10, print requirement determination section 25, text removal determination section 31, CPU 32 and ROM 33. Only the components those are not explained in the second embodiment are explained here. The components similar to those in the second embodiment are omitted of their explanations but are assigned with the same numerals.

Text removal detection section 31 serves to halt the controls to have the fusing temperature controlling section 23 raise the temperature of fusing section 22 or keep the fusing temperature upon determination of the removal of the text having set on scanner section 1 when the text presence signal output by text detection section 11 changes from 0V to 5V. The text removal detection section is activated such that CPU 32 executes the preset controlling program preliminary stored in ROM 33.

CPU 32 is a micro processor for controlling the entire apparatus by executing the preset controlling program preliminary stored in ROM 33. In addition to the ordinary control (the explanation thereof is omitted here), the CPU serves to activate fusing temperature controlling section 23, copying mode selecting recognizing section 4 and print requirement determination section 25 by executing the preset controlling program preliminary stored in ROM 33. Further, according to the present embodiment, the CPU serves to activate text removal detection section 31 by executing the preset controlling program preliminary stored in ROM 33.

ROM 33 is a read-only-memory in which a controlling program to be executed by CPU 32 for controlling the entire apparatus is preliminary stored. In addition to the ordinary controlling program (the explanation thereof is omitted here), the ROM is the read-only-memory in which the preset controlling program to be executed by CPU 32 for activating fusing temperature controlling section 23, copying mode selecting recognizing section 4 and print requirement determination section 25 is preliminary stored. Further, the ROM according to the present embodiment is the read-only-memory in which the controlling program to be executed by CPU 32 for activating text removal detection section 31 is preliminary stored.

Figure 11:
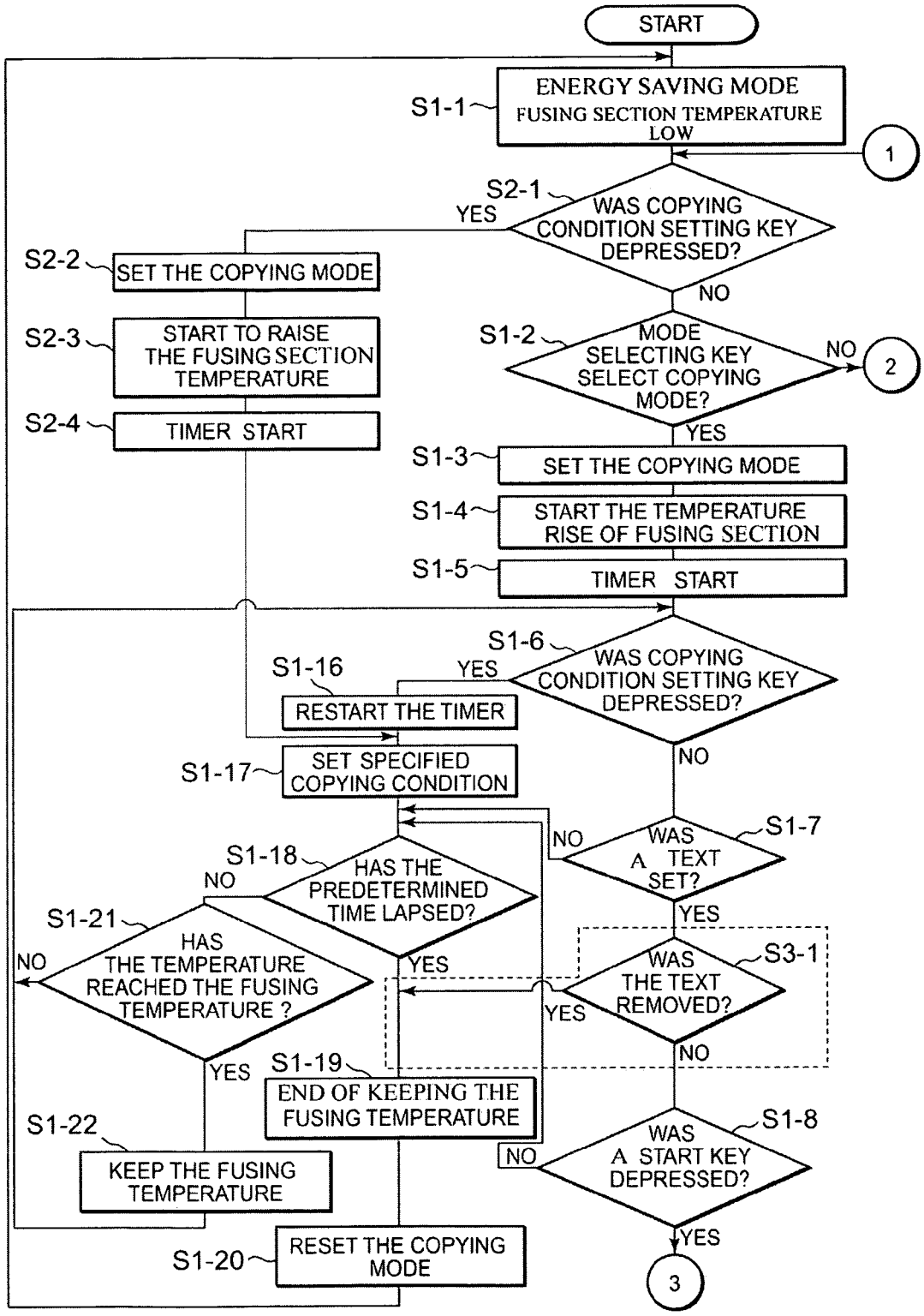
FIG. 11 is a flow chart I illustrating the operations of image forming apparatus according to the third embodiment.

FIG. 11 is a flow chart I illustrating operations of the image forming apparatus according to the third embodiment.

Figure 12:
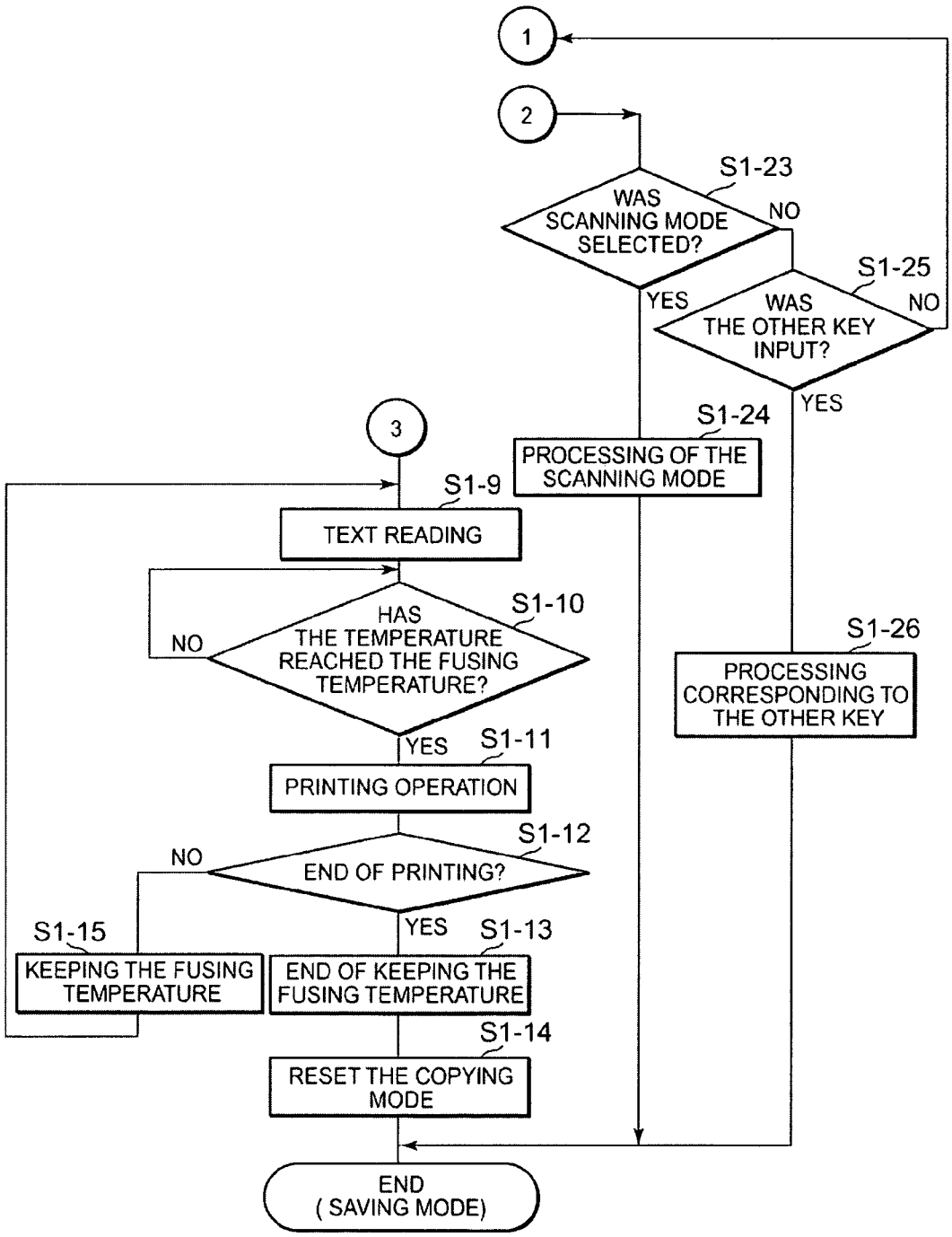
FIG. 12 is a flow chart II illustrating the operations of the image forming apparatus according to the third embodiment.

FIG. 12 is a flow chart II illustrating operations of the image forming apparatus according to the third embodiment.

These flows of the operations in FIGS. 11 and 12 can be achieved such that CPU 32 (FIG. 10) reads out and executes the controlling program stored in ROM 33 (FIG. 10). The operations of the image forming apparatus according to the present embodiment differs from those according to the second embodiment merely in that the encircled by dotted-line, namely, step S3-1, is additionally inserted between the steps S1-7 and S1-8 of the second embodiment. The other operations are identical to those in the image forming apparatus according to the second embodiment, and therefore the explanations are given only to the step S3-1 and the other operations are omitted for their explanations but are assigned with the same step numerals as those in the second embodiment.

Step S3-1 (FIG. 11)

Text removal detection section 31 (FIG. 10) detects that the text having set on scanner section 1 (FIG. 10) was removed when the text presence signal output from text detecting section 11 (FIG. 10) changes from 0V to 5V. As a result, the step goes to step S1-19 in order to halt the control to keep the fusing temperature of fusing section 22 (FIG. 10) performed by fusing temperature controlling section 23 (FIG. 10). Then, the similar flow of operations follows as in the operations according to the second embodiment.

As described above, the present embodiment produces such advantageous result that the equipment of text removal detection section 31 (FIG. 10) enables to avoid an unnecessary electric consumption because the fusing temperature keeping operation can be halt immediately when the text having once set is removed.

According to the present embodiment, once the copying mode has selected but is changed to the scanning mode halfway of copying operation, the printing operation is not required any more, and therefore, the mode change detection section is provided to halt keeping operation of the fusing temperature immediately upon detection of the mode change.

Figure 13:
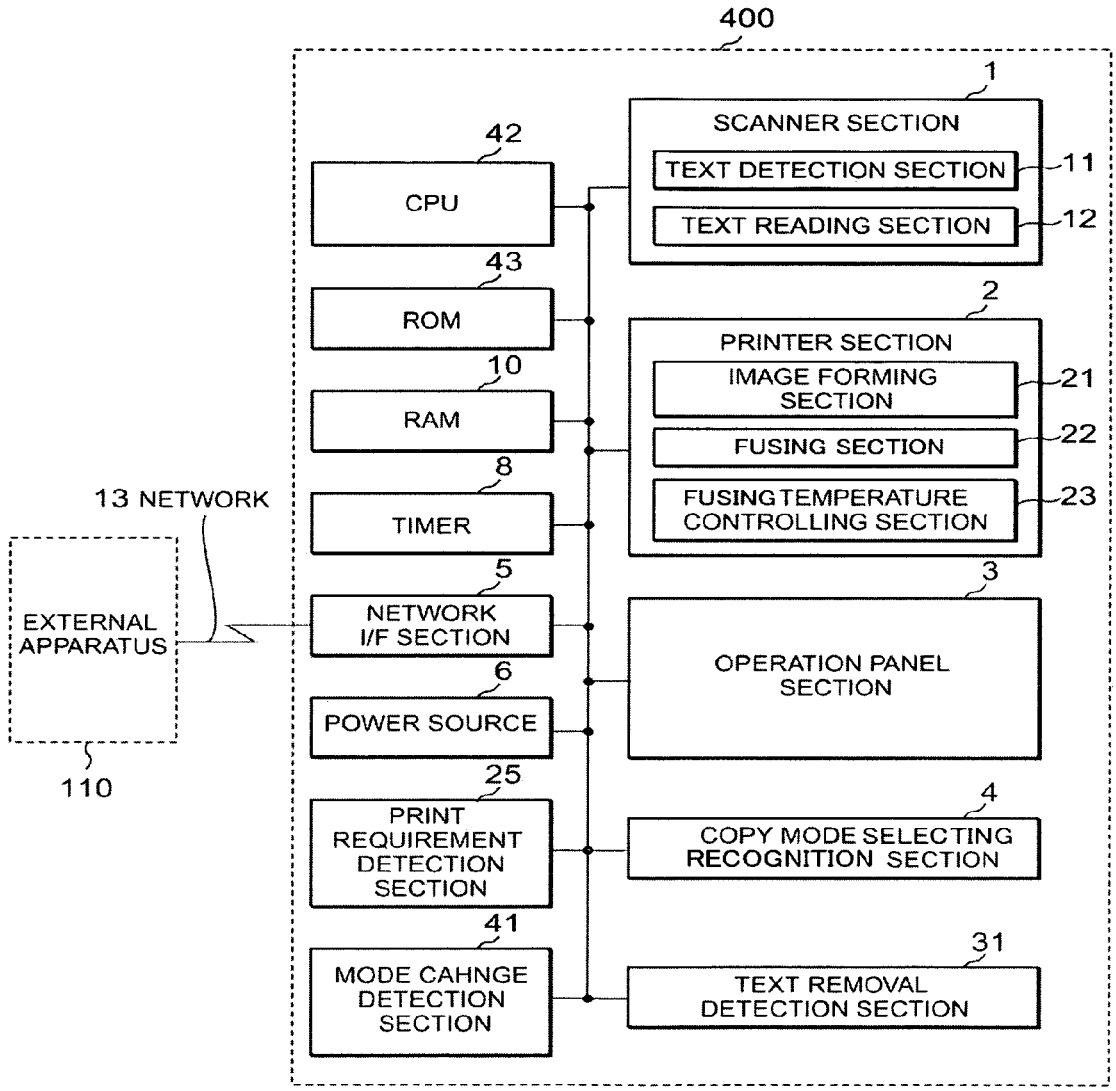
FIG. 13 is a block diagram illustrating a configuration of the image forming apparatus according to the fourth embodiment.

FIG. 13 is a block diagram illustrating a configuration of the image forming apparatus according to the fourth embodiment.

As shown in FIG. 13, image forming apparatus 400 has scanner section 1, printer section 2, operation panel section 3, copying mode selecting recognizing section 4, network I/F section 5, power source 6, timer 8, RAM 10, print requirement determination section 25, text removal detection section 31, mode change detection section 41, CPU 42 and ROM 43. The explanations are given to the only components which differ from those in the third embodiment. The components similar to those in the third embodiment are omitted for their explanations but are assigned with the same numerals as in the third embodiment.

Mode change detection section 41 detects a changing requirement requiring mode change from the copying mode to the scanning mode if the operator depresses scanning mode selecting key 212 (FIG. 4) halfway to set the copying condition to halt the fusing temperature controlling section 23 control to raise the temperature or control to keep the fusing temperature of fusing section 22. The mode change detection section is activated such that CPU 42 executes the preset controlling program preliminary stored in ROM 43.

CPU 42 is a micro processor for controlling the entire apparatus by executing the preset controlling program preliminary stored in ROM 143. In addition to the ordinary control (the explanation thereof is omitted here), the CPU activates fusing temperature controlling section 23, copying mode selecting recognizing section 4, print requirement determination section 25 and text removal detection section 31 upon execution of the preset controlling program preliminary stored in ROM 43. Further, the CPU of the present embodiment serves to activate mode change detection section 41 by executing the preset controlling program preliminary stored in ROM 43.

ROM 43 is a read-only-memory in which the controlling program to be executed by CPU 42 for controlling the entire apparatus is preliminary stored. In addition to the ordinary controlling program (the explanation thereof is omitted here), the ROM is the read-only-memory in which the controlling program to be executed by CPU 42 for activating fusing temperature controlling section 23, copying mode selecting recognizing section 4, print requirement determination section 25 and text removal detection section 31 is preliminary stored. Further, the ROM of the present embodiment is the read-only-memory in which the controlling program to be executed by CPU 42 for activating mode change detection section 41 is preliminary stored.

Figure 14:
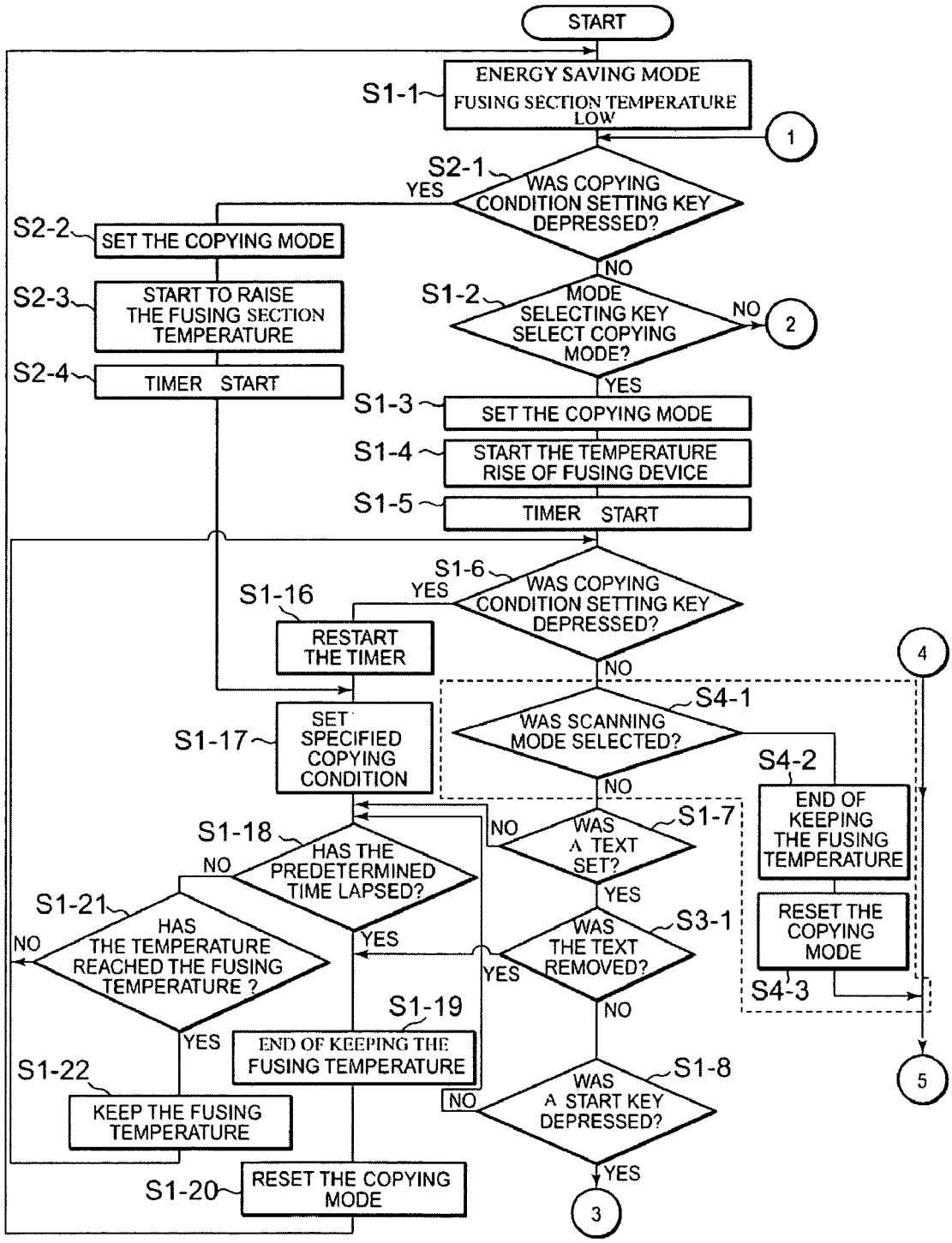
FIG. 14 is a flow chart I illustrating the operations of the image forming apparatus according to the fourth embodiment.

FIG. 14 is a flow chart I illustrating the operations of the image forming apparatus according to the fourth embodiment.

Figure 15:
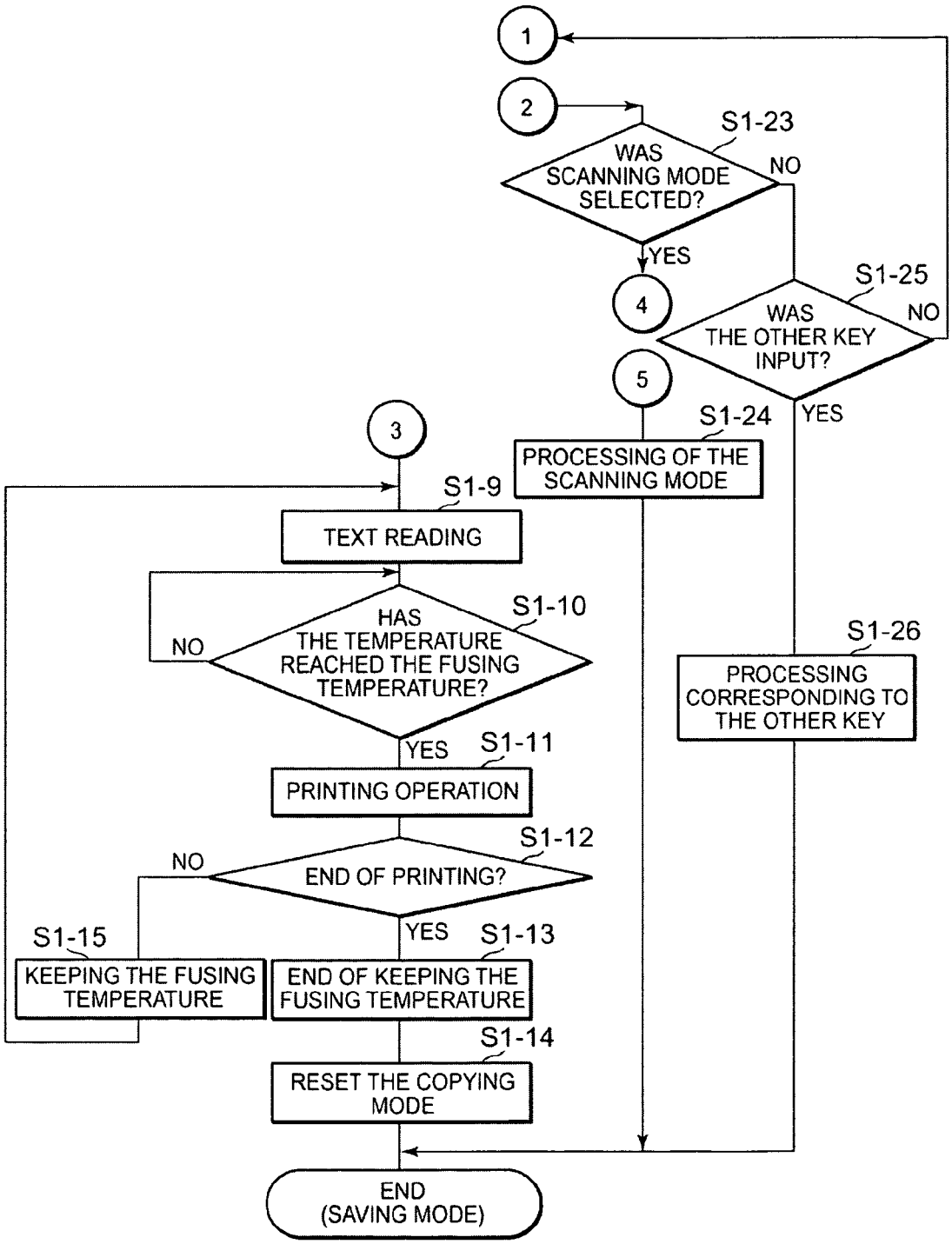
FIG. 15 is a flow chart II illustrating the operations of the image forming apparatus according to the fourth embodiment.

FIG. 15 is a flow chart II illustrating the operations of the image forming apparatus according to the fourth embodiment.

The flows as shown in FIGS. 14 and 15 can be achieved such that CPU 42 (FIG. 13) reads out and executes the controlling program stored in ROM 43 (FIG. 13). The operations of the image forming apparatus according to the present embodiment merely differs from those of the image forming apparatus according to the third embodiment in that additional operations encircled by a dotted line (namely, steps S4-1, S4-2 and S4-3) are inserted between the steps S1-6 and S1-7 of the third embodiment. The operations other than the above are identical to those of the image forming apparatus according to the third embodiment, and therefore, explanations are given only to the operations encircled by the dotted line (namely, steps S4-1, S4-2 and S4-3) and the identical steps of the present embodiment are assigned with the identical numerals as those of the third embodiment but are omitted for their explanations.

Step S4-1 (FIG. 14)

Mode change detection section 41 (FIG. 13), upon detecting that the operator depressed scanning mode selecting key 212 (FIG. 4) halfway of the setting operation of the copying condition, detects a mode change requirement requiring the mode change; from the copying mode to the scanning mode. As such, the step goes to S42. If the mode change detection section does not detect the mode change requirement, the steps goes to the step S1-7 to follow the flow of the operations in the copying mode.

Step S4-2

Mode change detection section 41 (FIG. 13) has fusing temperature controlling section 23 (FIG. 13) halt a control to keep the fusing temperature of fusing section 22 (FIG. 13).

Step S4-3

Mode change detection section 41 (FIG. 13) resets the copying mode and therefore the step goes to S1-25 (FIG. 15). Then, the step follows the similar flow of the operations as stated in the third embodiment.

As stated above, the image forming apparatus having mode change detection section 41 (FIG. 13) according to the present embodiment is capable of halting the operation to keep the fusing temperature immediately upon receiving the mode change requirement requiring to change the mode to the scanning mode on the way of operating the copying mode. Consequently, such advantageous result is obtainable that unnecessary electric consumption can be avoided.

In the above description, the present invention is exemplified limitatively in the case where the present invention is applied to the image forming apparatus having the scanner section and printer section; however, the present invention is not to be limited to such an example. Namely, the present invention is applicable to a copying machine, a facsimile machine and a multifunction system including a scanner and a printer.

As described above, it is obvious that this invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

an image reading unit for outputting an image data upon reading out an image on a text;

an image printing unit having an image forming section for forming an image on a predetermined recording medium on the basis of said image data, a fusing section for fusing thus formed image at a prescribed fusing temperature, and a fusing temperature controlling section for controlling said fusing temperature;

an operation section for enabling inputs of a plurality of operational items as to processing of said image data;

a print requirement determination section for determining as to whether or not an input of a specific operational item received from said operation section requires an image printing by said image printing unit; and a text removal detection section for detecting that the text having set on said image reading unit is removed therefrom, wherein said fusing temperature controlling section starts a control for raising a temperature of said fusing section on the basis of a determination by said print requirement determination section that an image printing is required, and wherein said text removal detection section, upon detection of the removal of said text, has said fusing temperature controlling section halt the control to raise the temperature of said fusing section.

2. The image forming apparatus of claim 1 wherein:

the plurality of operational items further includes a first item configuring a function requiring an image printing and a plurality of a second item configuring a printing condition of the function requiring the image printing, the input of a specific operation item of the print requirement determination section is at least one of the plurality of the first item or of the second item, and at least one of the plurality of the second item is received prior to receiving at least one of the plurality of the first item in the fusing temperature controlling section.

3. The image forming apparatus as claimed in claim 2, wherein one of the plurality of the first item configuring a function requiring an image printing is a copying mode selecting operation of the image on said text.

4. The image forming apparatus according to claim 3, wherein one of the plurality of the second item configuring a printing condition of the function requiring the image printing is a copying magnitude setting operation of the image on said text.

5. The image forming apparatus according to claim 3, wherein one of the plurality of the second item configuring a printing condition of the function requiring the image printing is a copying resolution setting operation of the image on said text.

6. The image forming apparatus according to claim 3, wherein one of the plurality of the second item configuring a printing condition of the function requiring the image printing is a copying-number setting operation of the image on said text.

7. The image forming apparatus according to claim 2, wherein one of the plurality of the second item configuring a printing condition of the function requiring the image printing is a copying magnitude setting operation of the image on said text.

8. The image forming apparatus according to claim 7, wherein one of the plurality of the second item configuring a printing condition of the function requiring the image printing is a copying resolution setting operation of the image on said text.

9. The image forming apparatus according to claim 7, wherein one of the plurality of the second item configuring a printing condition of the function requiring the image printing is a copying-number setting operation of the image on said text.

10. The image forming apparatus according to claim 2, wherein one of the plurality of the second item configuring a printing condition of the function requiring the image printing is a copying resolution setting operation of the image on said text.

11. The image forming apparatus according to claim 2, wherein one of the plurality of the second item configuring a printing condition of the function requiring the image printing is a copying-number setting operation of the image on said text.

12. An image forming apparatus comprising:

an image reading unit for outputting an image data upon reading out an image on a text;

an image printing unit having an image forming section for forming an image on a predetermined recording medium on the basis of said image data, a fusing section for fusing thus formed image at a prescribed fusing temperature, and a fusing temperature controlling section for controlling said fusing temperature;

an operation section for enabling inputs of a plurality of operational items as to processing of said image data;

a print requirement determination section for determining as to whether or not an input of a specific operational item received from said operation section requires an image printing by said image printing unit; and a mode change detecting section for detecting a change of mode from the operational item requiring the image printing to the operational item not requiring the image printing, wherein the fusing temperature controlling section starts a control for raising a temperature of the fusing section on the basis of the determination by the print requirement determination section that the image printing is required, and wherein the fusing temperature controlling section halts the control for raising the temperature of the fusing section on the basis of a notification from the mode change detecting section that the mode is changed to the operational item not requiring the image printing while the temperature of the fusing section is being raised.

13. The image forming apparatus as claimed in claim 12, wherein said mode change detecting section upon detecting a change of mode from a copying mode to a scanning mode while controlling the temperature of said fusing section on the basis of the determination by said print requirement determination section that the image printing is required halts the fusing temperature controlling section control to raise the temperature of the fusing section.

14. An image forming apparatus of claim 12 wherein:

the plurality of operational items further includes a first item configuring a function requiring an image printing and a plurality of a second item configuring a printing condition of the function requiring the image printing, the input of a specific operation item of the print requirement determination section is at least one of the plurality of the first item or of the second item, and at least one of the plurality of the second item is received prior to receiving at least one of the plurality of the first item in the fusing temperature controlling section.

15. The image forming apparatus according to claim 14, wherein one of the plurality of the first item configuring a function requiring an image printing is a copying mode selecting operation of the image on said text.

16. The image forming apparatus according to claim 15, wherein one of the plurality of the second item configuring a printing condition of the function requiring the image printing is a copying magnitude setting operation of the image on said text.

17. The image forming apparatus according to claim 15, wherein one of the plurality of the second item configuring a printing condition of the function requiring the image printing is a copying resolution setting operation of the image on said text.

18. The image forming apparatus according to claim 15, wherein one of the plurality of the second item configuring a printing condition of the function requiring the image printing is a copying-number setting operation of the image on said text.

19. The image forming apparatus according to claim 14, wherein one of the plurality of the second item configuring a printing condition of the function requiring the image printing is a copying magnitude setting operation of the image on said text.

20. The image forming apparatus according to claim 19, wherein one of the plurality of the second item configuring a printing condition of the function requiring the image printing is a copying resolution setting operation of the image on said text.

21. The image forming apparatus according to claim 19, wherein one of the plurality of the second item configuring a printing condition of the function requiring the image printing is a copying-number setting operation of the image on said text.

22. The image forming apparatus according to claim 14, wherein one of the plurality of the second item configuring a printing condition of the function requiring the image printing is a copying resolution setting operation of the image on said text.

23. The image forming apparatus according to claim 14, wherein one of the plurality of the second item configuring a printing condition of the function requiring the image printing is a copying-number setting operation of the image on said text.

* * * * *